United States Patent [19]

Bjorklund

[11] 4,065,400

[45] Dec. 27, 1977

[54] NUCLEAR WASTE SOLIDIFICATION

[75] Inventor: William J. Bjorklund, Richland, Wash.

[73] Assignee: The United States of America as represented by the United States Energy Research and Development Administration, Washington, D.C.

[21] Appl. No.: 675,086

[22] Filed: Apr. 8, 1976

[51] Int. Cl.[2] ..... G21F 9/14

[52] U.S. Cl. ..... 252/301.1 W

[58] Field of Search ..... 252/301.1 W

[56] References Cited

U.S. PATENT DOCUMENTS 3,862,296 1/1975 Dotson et al. ..... 252/301.1 W

OTHER PUBLICATIONS

Amphlett, C. B., Treatment and Disposal of Radioactive Wastes (Pergammon Press New York 1961), pp. 87–93.

Thompson, T. K. et al., "Fluidized Bed Calcination of Radioactive Wastes Using In-Bed Combustion Heating" Nuclear Technology, vol. 16, 11–72, pp. 396–405.

*Primary Examiner*—Benjamin R. Pagett
*Assistant Examiner*—Deborah L. Kyle
*Attorney, Agent, or Firm*—Dean E. Carlson; Richard E. Constant; Ignacio Resendez

[57] ABSTRACT

High level liquid waste solidification is achieved on a continuous basis by atomizing the liquid waste and introducing the atomized liquid waste into a reaction chamber including a fluidized, heated inert bed to effect calcination of the atomized waste and removal of the calcined waste by overflow removal and by attrition and elutriation from the reaction chamber, and feeding additional inert bed particles to the fluidized bed to maintain the inert bed composition.

4 Claims, 1 Drawing Figure

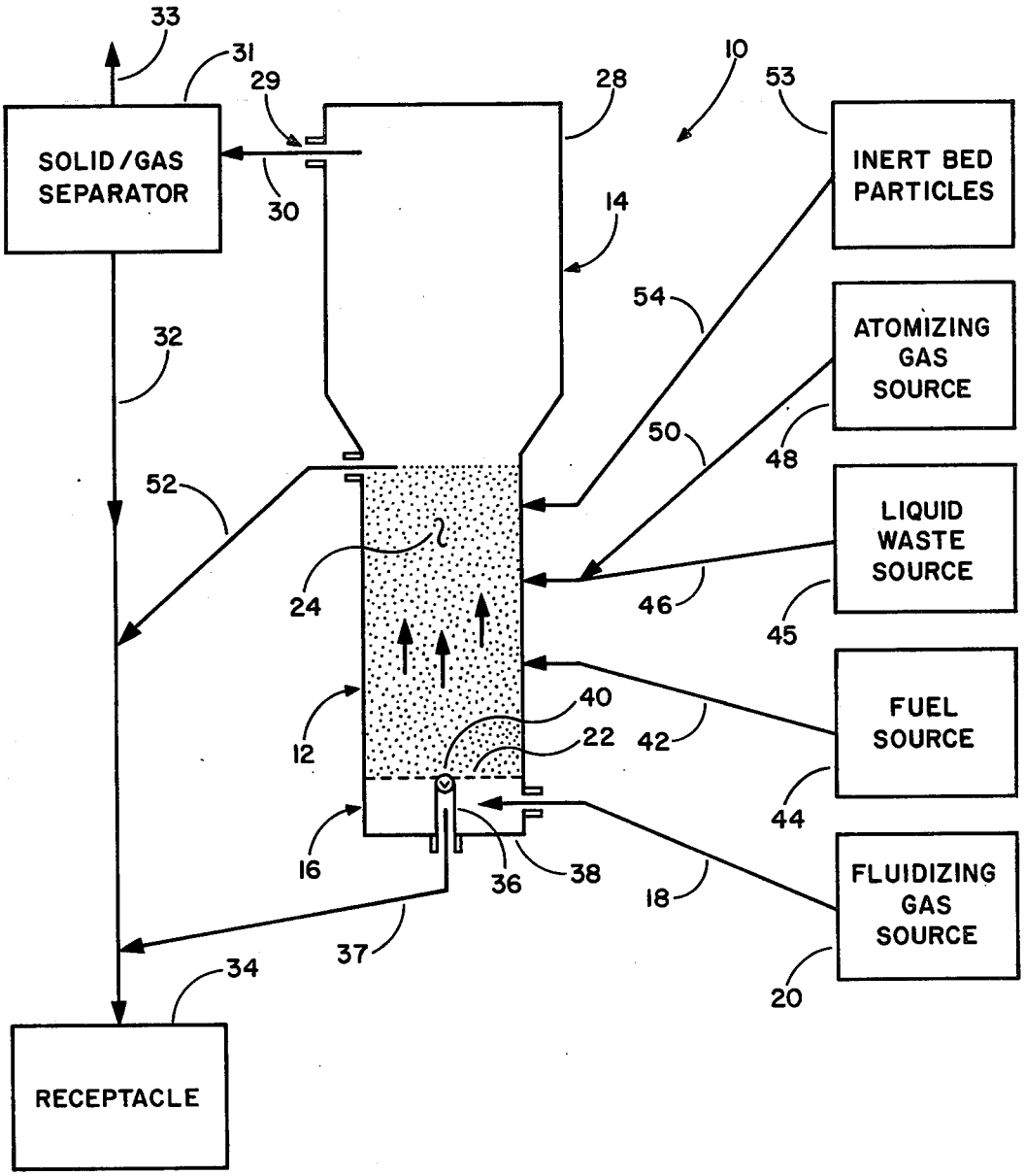
SOLID/GAS SEPARATOR
INERT BED PARTICLES
ATOMIZING GAS SOURCE
LIQUID WASTE SOURCE
FUEL SOURCE
FLUIDIZING GAS SOURCE
RECEPTACLE
33
31
29
28
10
53
30
14
54
32
50
48
52
24
46
45
40
22
42
12
44
16
36
38
18
37
34
20

NUCLEAR WASTE SOLIDIFICATION

BACKGROUND OF THE INVENTION

The invention relates to continuous solidification of radioactive liquid waste.

The invention described herein was made in the course of, or under, a contract with the U.S. Energy Research and Development Administration.

Calcination of high level radioactive waste using fluidized bed techniques has been generally investigated. As used herein, "high-level radioactive liquid wastes" refers to those aqueous wastes resulting from the operation of a first cycle solvent extraction system, and the concentrated wastes from subsequent extraction cycles in a facility for reprocessing irradiated nuclear reactor fuels. These wastes may contain virtually all of the nonvolatile fission products, several tenths of one percent of the uranium and plutonium originally in the spent fuels, and all the other actinides formed by transmutation of the uranium and plutonium as normally produced in a nuclear reactor.

The processes resulting from previous investigations have been apropos for some specific applications, but had inherent limitations or disadvantages for other applications such as where continuous waste solidification was required. For example, prior art processes for calcining liquid radioactive waste in a fluidized bed reactor may have one or more of the following limitations:

a high inventory of fission products is maintained in the calciner bed resulting in decay heat problems;

continuous operation may not be feasible because of the requirement of "art" or operator control steps peculiar to the process for which there cannot be an automatic compensation;

previous beds may not achieve equilibrium within short time spans and therefore require a long waiting period for bed turnover;

operation in some processes was limited to temperatures below about 400° C because the bed material had a low melting composition, and the resulting product had a high nitrate and water concentration;

prior art processes generally do not permit successful calcination of sodium bearing wastes without significant addition of feed additives;

and, finally, when prior art processes are adjusted or modified to eliminate one or another of the recited limitations, the resultant products may have inferior or undesirable vitrification properties.

SUMMARY OF INVENTION

In view of the above recited limitations, it is an object of this invention to provide for continuously solidifying high level radioactive liquid wastes and recovering the calcined solidified product.

It is a further object of this invention to provide for solidification of high level liquid wastes wherein a minimum inventory of fission products is maintained in the calciner bed and decay heat problems are minimized.

It is a further object of this invention to provide a continuous process for liquid waste solidification wherein the calcined product particle size may be controlled and is readily vitrifiable.

It is a further object of this invention to provide a process for solidifying liquid waste employing a fluidized silica bed wherein equilibrium between the inert silica bed and the calcined radioactive waste is rapidly achieved.

It is a further object of this invention to provide a process operable at relatively high temperatures, for solidifying liquid waste, to yield a product which has a low nitrate and water concentration.

It is a further object of this invention to provide a high temperature process for solidifying liquid waste applicable to the calcination of sodium bearing wastes without the need for extraneous feed additives.

Various other objects and advantages will appear from the following description of this invention and the most novel features will be particularly pointed out hereinafter in connection with the appended claims. It will be understood that various changes in the details, materials, and layout of the apparatus and process which are herein described and illustrated in order to explain the nature of the invention may be effected by those skilled in the art without departing from the scope of this invention.

The invention comprises, in brief, a method for continuously solidifying high level radioactive liquid waste comprising introducing an inert particulate material into a reaction chamber, heating the particulate material and the chamber to from about 400° to about 1300° C, dispersing a gas beneath the particulate material to agitate same and form a fluidized bed, atomizing the radioactive liquid waste and dispersing the atomized waste into the fluidized bed to effect calcination of the waste, continuing gas dispersal beneath the fluidized bed to effect attrition and elutriation of the calcined products from the bed, and removing attrited and elutriated calcine products from the reaction chamber via fluidizing gas, and removing calcined product and inert bed material from an upper portion of the fluidized bed, and recovering the calcined products.

DESCRIPTION OF DRAWING

The drawing represents a partially diagrammatic cut-away side view of one embodiment of this invention.

DETAILED DESCRIPTION

The drawing illustrates apparatus that may be used in practicing this invention. The calciner vessel 10 includes a lower reaction section 12 and an upper recovery of disengaging section 14 which is of greater cross-sectional area than the lower reaction portion 12 to permit disengaging of particles from the gas, as is generally known in the art. Beneath the lower reaction section 12 is a gas inlet section 16 which receives a fluidizing gas 18 such as air from a suitable source 20. The gas is uniformly distributed throughout the cross-section of the reaction section 12 by gas distribution plate 22 in order to uniformly disperse and fluidize the bed material 24 and effect the desired reaction. The fluidizing gas and elutriated particles then pass into disengaging section 14 and subsequently exit section 14 through port 29 via conduit 30 interconnecting an upper portion 28 of section 14 with a solids/gas separator means 31 such as a cyclone in combination with appropriate filters medium as sintered metal filters or the like. The elutriated solids are separated from the gas in separator means 31 and pass through conduit 32 and collected or otherwise treated in collecting means or receptacle 34. Arrow 33 indicates the removal of gases from the solids separator means.

Conduit 36 interconnects bed support wall or gas distribution plate 22 with a bottom wall 38 of calciner vessel 10 and provides a passageway for removal of particulate material from the lower reaction section 12 to receptacle 34, as indicated by arrow 37. A valve 40 is likewise provided to control removal of the particulate material. Conduit 36 and valve 40 may be used, for example, when it is desired to completely remove the bed from section 12 at the end of a run, or in other like circumstances. Normally the valve is closed during continuous high level radioactive liquid waste solidification processing.

Appropriate heating means, such as an electrical resistance heater, may be used to heat the fluidized bed 24 within the calciner vessel. Alternatively, a fuel may be supplied to and combusted within lower reaction section 12 to provide the desired heating, as generally known in the art. A conduit, indicated by arrow 42 may feed fuel from fuel source 44 into lower reaction portion 12 for these latter described systems. A suitable fuel mixture in such a system may be such as oxygen and propane or kerosene.

Heating of the fluidized bed may be to a temperature of from about 400° to about 1300° C and preferably is at a temperature of from about 400° to about 800° C. Heating in these ranges provides desirable process and product characteristics such as high combustion rates, minimal nitrate content in product, and the like.

The inert bed material 24 is granular, inert silica ($SiO_2$) in the form of sand or the like, which inert bed material is durable and insensitive to extreme temperature changes, and is not chemically affected by the high level radioactive waste feed material or melted or otherwise affected by the temperatures encountered in processing. The inert bed material or silica particles may have an average particle diameter of from about 0.20 to about 0.40 millimeters. While silica is referred to herein, other inert bed materials may likewise be used. Fluidizing gas is passed through the gas distribution plate 22 at a velocity sufficient to effectively fluidize the material to the desired level as known in the art.

High level liquid radioactive waste feed solutions from source 45 is passed into lower reaction section 12 through feed conduit 46. The radioactive liquid waste is atomized by introducing an atomizing gas from atomizing gas source 48 through suitable conduit 50 which is interconnected with conduit 46 at an appropriate location. The atomizing gas may be air or another suitable gas. One or more atomizing nozzles (not shown) may be interconnected with conduit 46 and strategically located to feed the atomized waste into the fluid bed. For example, a plurality of nozzles may be conveniently located around a circumference of lower reaction portion 12 for atomizing the liquid radioactive waste and directing it into the fluidized bed section. It may be desirable to locate the atomizing nozzles adjacent the combustion zone, if fuel combustion is used for heating, to achieve high feed rates. Atomized waste feed at a generally upper portion of the fluidized bed section may enhance attrition, and would be favored where a high attrition rate and a low inert bed loss through carryover are desired.

The feed solutions introduced into lower reaction portion 12 are converted to metal oxides (referred to herein as calcine) and nonmetal oxides (off-gas). The calcine either coats the inert silica bed particles, is spray dried, or coats and attrits from the inert particles. The result may be influenced by manipulating several variables such as feed composition, atomizing gas rates, temperatures, etc.

Overflow conduit 52 provides a passageway for overflow removal of a portion of the calcined material from the fluidized bed. As the atomized liquid waste is fed into the fluidized bed, the radioactive waste becomes calcined, may dry as a spray, and may coat onto the inert bed material such as silica particles and attrit therefrom through contact with other particulate material from movement thereof in the fluidized bed such that the attrited particles or fines of calcine are elutriated and separted from the gas by solids and gas separator means 31.

An upper portion of the fluidized bed particle may be removed through overflow into conduit 52 to effect rmoval of a portion of the calcine material with some inert bed material. The resultant product collected in receptacle 34 may be readily vitrified. Further, this enables the provision of fresh inert bed material from inert bed particle reservoir or source 53 through conduit 54 to continuously maintain the calcination process.

At or near the same time as waste feed is introduced, addition of inert material from the inert material storage container to the reaction chamber may be initiated. The rate of addition and whether it is continous or semi-continuous is dependent on the specific calcination process being operated. As a lower limit, the rate of inert addition will be equal to the bed material attrited and elutriated to maintain the desirable fluidization quality. An upper limit would be dependent on the next processing step, i.e., the weight ratio of calcined oxides to inerts desired, calcine inventory of the bed, etc. Acceptable operation from a nil rate to ten times the calcine oxide generation have been practiced.

Control of the bed level is appropriately maintained by the overflow conduit in the bed or by using a control valve in that conduit. If waste feed rates change, inert addition is correspondingly adjusted. This ability to have continuous control over the material in the reaction chamber is a further distinquishing feature of this process from previous calcination operations. For example, if it is noted that the particles in the bed are getting too big, small sized silica particles may be added, while if the bed particles are getting too small, larger sized silica particles may be added. Thus much better control of the bed and of the resultant product may be achieved.

Overflow removal of inert bed material may be minimized if the desired product is to have a low silica content. In this case, it may be further desirable to provide means for increasing attrition and fine formation of the calcined waste, Such as by introducing high velocity jet streams into the fluid bed to enhance or promote turbulence and an increased attrition rate. In a high attrition rate process, the fluidized bed may be comprised of from about 10 to about 15 weight percent calcined radioactive waste, the remainder being inert bed particles such as silica. The resultant calcined waste recovered product would be about 90 weight percent calcined waste and about 10 weight percent silica.

If the product is to be vitrified, calcined waste recovered product may be processed to contain about 50 weight percent calcine waste and about 50 weight percent silica.

The material that is collected in the collection and/or storage receptacle 34 may be used for processing the calcined material into a furnace to accomplish melting and subsequent transfer to a melt receiver for encapsulation. In the alternative, the calcined material may be stored for an indefinite period. The collection receptacle 34 may be substituted with a suitable melter for vitrification purposes.

In one embodiment of the invention, the calciner vessel was 1.7 meters long and had a 17.1 centimeters square bed section and a 24.8 centimeter square disengaging section. The vessel employed a perforated gas distributor plate. As shown in the drawing, product materials exited the calciner vessel by way of an overflow conduit 52, off-gas conduit 30, and a bed removal conduit 36. The overflow conduit 52 and the bed removal conduit 36 communicate with a gas particulate separator means 31 via conduit 32. Gas and particulates were separated by a cyclone and sintered metal filters. Conventional blowback procedures were employed to maintain satisfactory low pressure drop across the filters.

In an operation of this invention, a starting bed of inert material of silicon dioxide was fluidized at about 30 centimeter per second superficial velocity while process heat was supplied by the combustion of oxygen and kerosene directly into the bed. As waste feed was introduced though an air atomized nozzle and the calcination reaction occurred, the continuous addition of inert to the bed was started. The calcine coated the particles, was spray dried, or coated and attrited from the material. Product was overflowed and/or elutriated from the bed to maintain the proper inventory. By using jet grinders, high attrition type feed nozzles or operating conditions (such as high temperature, high fluidizing velocity) conducive to the generation of fines, the amount of calcine in the bed was reduced significantly because of high attrition rates and of spray drying of the waste. The particle size of the inert silica particulate material added was generally in the size range of from about 0.2 to about 0.4 millimeters in diameter. The rate of inert solids addition was dependent on the next processing step and may be generaly equivalent to the bed attrition rate, i.e., that necessary to maintain proper fluidized bed level.

When the calcined waste material is to be vitrivied, the weight of inert material added to the fluidized bed would be about equal to the weight of the calcine oxide being generated. Glass frit would be added to the melter used for vitrification. Because the reaction bed is silica, the inert mateial carried over into the collection receptacle or the melter is readily incorporated in the frit. This invention is versatile over wide operating ranges, as indicated by the summary of several runs in the Table. The process readily accommodates most waste compositions. The calciner or reaction vessel has been coupled directly to an in-can melter and indirectly to a continuous ceramic melter without any problems. Sintered metal filters have been used satisfactorily in separating particulate material from gases.

TABLE

| | |
|---|---|
| Feed Types | 320 - 575 l/MTU[a]<br>0.01 - 1M Na[b]<br>80 - 210 g oxide/l[c] |
| Feed Rates | 20 - 40 l/hr<br>80 - 120 l/hr/ft$^2$ of bedcross sectional area |
| Atomizing Air to Feed Volumetric Ratios | 200 -700 |
| Vessel Operating Pressure | 740 mm mercury |
| Operating Temperature | 500 -800° C |
| Bed Properties | 0.2 - 0.5 mm dia. 14 - 50%<br>calcine Avg. ~ 20% |
| Product Properties | 0.1 - 0.3 mm dia.<br>Heavy fines or no fines |

TABLE-continued

| | |
|---|---|
| | dependent on feed, etc. |

[a]MTU = Metric ton of uranium processed
[b]M Na = Molar Sodium
[c]g oxide/l = grams calcine per liter of high level waste As noted in the Table, the feed materials ranged from 320 to 575 liters of waste feed obtained from a metric ton of uranium processed. These feed materials contained from 80 to 210 grams of calcine per liter of liquid waste, and contained from 0.01 molar to 1 molar sodium. In the apparatus described having the aforesaid dimensions, the feed rates of high level liquid waste were from 20 to 40 liters per hour, and employed air as the atomizing gas at volumetric ratios of atomizing gas to liquid feed of from about 200 to about 700. In this particular series, the operating temperature ranged from 500° C to 800° C.

The calcine product properties ranged from 0.1 to 0.3 millimeters diameter. These were controlled by inert addition rate, varying the feed rates, adjusting the atomizing gas rates, etc.

Distinct advantages of this invention are that the fission product inventory in the bed is substantially reduced, with the concurrent effect of substantially reducing the danger of a temperature excursion due to self-heating of the bed following a loss of fluidizing air incident or agglomeration of the bed. Second, the bed is operated in an attriting or grinding fashion to discharge the calcine as an overhead powder, together with an overflow of silica particles having a thin calcine waste coating thereon, and supplementary inert bed particles are added to the fluidized bed to achieve continuous operation. Third, the use of silica particles permits high temperature operation, even as high as from about 400° C to 1300° C.

What we claim is:

1. A process for continuously solidifying high level radioactive waste resulting from reprocessing irradiated nuclear reactor fuels anc containing virtually all of the nonvolatile fission products, several tenths of one percent of the uranium and plutonium originally in the irradiated fuels, and other actinides formed by transmutation of the uranium and plutonium as normally produced in a nuclear reactor, by using a fluidized inert bed having a minimal fission product inventory comprising introducing an inert particulate material comprising silica particles having an average particle diameter of from about 0.20 to about 0.40 mm into a chamber; heating said material to from about 400° to about 1300° C; dispersing air as a fluidizing gas beneath said material to agitate same and form a fluidized bed; atomizing said radioactive liquid waste; introducing said atomized waste into an upper portion of said heated, fluidized bed to effect calcination of said waste and formation of a fluidized inert bed with said atomized waste comprising from about 10 to about 15 weight percent calcined radioactive waste and from about 90 to 85 weight percent silica particles, a first portion of said calcined waste being spray dried, a second portion of said calcined waste depositing and remaining on said particulate fluidized bed material, and a third portion of said calcined waste depositing on said bed material and attriting therefrom; removing solid calcine radioactive waste from said reactor chamber, said removing comprising elutriating said spray dried first portion, elutriating said attrited third portion, separating said elutriated solid calcine waste from said fluidizing gas, and overflowing said second portion from said fluidized bed at an about upper portion of said fluidized bed, said introducing of said atomized waste at an upper portion of said inert fluidized bed enhancing attrition and minimizing inert bed loss through overflow; introducing additional inert particulate material into said reaction chamber to maintain said inert fluidized bed; continuing said atomizing, calcining and removing of said solidified radioactive waste, and collecting said first, second and third portions removed from said fluidized inert bed as a readily vitrifiable product comprising about 90 weight percent calcined waste and about 10 weight percent silica, and having an average particle diameter of from about 0.1 mm to about 0.3 mm.

2. The process of claim 1 wherein said heating is at from about 400° to about 800° C.

3. The product formed by the process of claim 1.

4. The process of claim 1 wherein said high level radioactive liquid waste comprises from 320 to 575 liters of waste feed obtained from the processing of a metric ton of uranium, said feed materials yield from 80 to 210 grams of calcine per liter of liquid waste, and the concentration of sodium in said feed materials is from 0.01 molar to 1 molar said radioactive liquid waste is atomized at the rate of 20 to 40 liters per hour; and said heating is to a temperature of from about 500° to about 800° C.

* * * * *